US009037024B2

(12) United States Patent
Kasama

(10) Patent No.: US 9,037,024 B2
(45) Date of Patent: May 19, 2015

(54) FUSING DEVICE INCLUDING NIP REGULATING MEMBER HAVING FLAT AND ARC-SHAPED SURFACES AND IMAGE FORMING APPARATUS INCLUDING THE FUSING DEVICE

(71) Applicant: Kyocera Document Solutions Inc., Osaka (JP)

(72) Inventor: Kenichi Kasama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 85 days.

(21) Appl. No.: 13/867,713

(22) Filed: Apr. 22, 2013

(65) Prior Publication Data

US 2013/0279957 A1 Oct. 24, 2013

(30) Foreign Application Priority Data

Apr. 23, 2012 (JP) ..... 2012-097361

(51) Int. Cl.
*G03G 15/20* (2006.01)

(52) U.S. Cl.
CPC ..... *G03G 15/2085* (2013.01); *G03G 15/2028* (2013.01); *G03G 15/2064* (2013.01); *G03G 2215/2035* (2013.01)

(58) Field of Classification Search
CPC ..... G03G 15/2089; G03G 15/2017; G03G 2215/2035
USPC ..... 399/67, 329; 219/216
See application file for complete search history.

(56) References Cited

U.S. PATENT DOCUMENTS

| | | | | |
|---|---|---|---|---|
| 8,417,167 | B2 | 4/2013 | Arikawa et al. | |
| 8,447,219 | B2 * | 5/2013 | Furukata et al. | 399/329 |
| 8,655,211 | B2 * | 2/2014 | Fujimoto et al. | 399/67 |
| 2011/0236069 | A1 | 9/2011 | Arikawa et al. | |

FOREIGN PATENT DOCUMENTS

| | | | | |
|---|---|---|---|---|
| JP | 10228200 | A | * | 8/1998 |
| JP | 2004126110 | A | * | 4/2004 |
| JP | 2007163692 | A | * | 6/2007 |
| JP | 2008-233133 | A | | 10/2008 |
| JP | 2008233133 | A | * | 10/2008 |
| JP | 2009-168909 | A | | 7/2009 |
| JP | 2011-197610 | A | | 10/2011 |

* cited by examiner

*Primary Examiner* — Robert Beatty
(74) *Attorney, Agent, or Firm* — Studebaker & Brackett PC

(57) ABSTRACT

A fusing device includes a regulating member and a switching mechanism. The regulating member has a flat surface and an arc-shaped surface and regulates a nip formed by a belt and a roller. The switching mechanism switches the fusing device between a first mode and a second mode in which an unfused toner image is fused to a recording medium. The flat surface is provided along a direction in which the recording medium enters the nip. The arc-shaped surface is provided downstream of the flat surface in the recording medium entry direction, is contiguous to the flat surface, and is curved toward the roller. In the first mode, the nip is regulated by the flat surface and the arc-shaped surface. In the second mode, the nip is regulated by the flat surface of the flat and arc-shaped surfaces.

16 Claims, 7 Drawing Sheets

FUSING DEVICE INCLUDING NIP REGULATING MEMBER HAVING FLAT AND ARC-SHAPED SURFACES AND IMAGE FORMING APPARATUS INCLUDING THE FUSING DEVICE

INCORPORATION BY REFERENCE

The present application claims priority under 35 U.S.C. §119 to Japanese Patent Application No. 2012-097361, filed Apr. 23, 2012. The contents of this application are incorporated herein by reference in their entirety.

BACKGROUND

The present disclosure relates to fusing devices for fusing unfused toner images to a recording medium by inserting and passing the recording medium carrying the unfused toner images into and through a fusing nip formed by a belt and a roller which are pressed against and made contact with each other, and thereby applying heat and pressure to the recording medium, and to image forming apparatuses including such a fusing device.

In conventional image forming apparatuses, toner images formed on an image carrier, such as a photoconductive drum or the like, are transferred to a recording medium. The recording medium carrying the toner images is conveyed toward a fusing device. The fusing device fuses the toner images to the recording medium by applying heat and pressure thereto. Among fusing devices is a belt fusing device. The belt fusing device fuses unfused toner images to a recording medium by inserting and passing the recording medium carrying the unfused toner image into and through a fusing nip. The fusing nip is formed by an endless fusing belt heated and a pressure roller. The fusing belt is pressed against and made contact with the pressure roller.

In the belt fusing device, a pressing member is provided inside the fusing belt, and the pressure roller is pressed against the pressing member from the outside of the fusing belt. Also, in the belt fusing device, the fusing belt is driven to rotate while sliding on the pressing member with the inner surface of the fusing belt being in contact with the pressing member. Also, in the belt fusing device, the surface of the pressing member on which the fusing belt slides has a flat or arc-shaped surface to provide a wide nip width, whereby fusing performance and recording medium releasability are improved.

However, if the pressing member has the arc-shaped sliding surface, then when unfused toner images are fused to a recording medium, such as an envelope or the like, the front and back sides of the envelope have different conveyance speeds at the fusing nip, so that the front and back sides of the envelope are wrinkled, or the flap of the envelope is not correctly placed at a predetermined position (flap misalignment).

There is a known conventional technique of preventing or reducing the formation of wrinkles and the like on an envelope during the fusing process. For example, some fusing devices include a pressing member including a soft pad of an elastic soft material and a hard pad of a hard material, and a switching mechanism which can switch the fusing device between a normal mode in which fusing is performed on plain paper, such as A4 paper and the like, and an envelope mode. In the normal mode, the soft and hard pads are pressed against and made contact with the fusing belt, whereby a fusing nip is formed. On the other hand, in the envelope mode, the hard pad is separated by the switching mechanism, so that only the soft pad is pressed against and made contact with the fusing belt, whereby a fusing nip is formed. As a result, the nip pressure is reduced, and therefore, wrinkles and flap misalignment of the envelope are reduced.

SUMMARY

According to a first aspect of the present disclosure, a fusing device fuses an unfused toner image formed on a recording medium, to the recording medium. The fusing device includes a regulating member and a switching mechanism. The regulating member has a flat surface and an arc-shaped surface and regulates a nip formed by an endless belt and a roller. The switching mechanism switches the fusing device between a first mode and a second mode in which the unfused toner image is fused to the recording medium. The flat surface is provided along a direction in which the recording medium enters the nip. The arc-shaped surface is provided downstream of the flat surface in the recording medium entry direction, is contiguous to the flat surface, and is curved toward the roller. In the first mode, the nip is regulated by the flat surface and the arc-shaped surface. In the second mode, the nip is regulated by the flat surface of the flat and arc-shaped surfaces.

According to a second aspect of the present disclosure, an image forming apparatus includes an image forming unit and a fusing device. The image forming unit forms a toner image on a recording medium. A fusing device fuses an unfused toner image formed on a recording medium, to the recording medium. The fusing device includes a regulating member and a switching mechanism. The regulating member has a flat surface and an arc-shaped surface and regulates a nip formed by an endless belt and a roller. The switching mechanism switches the fusing device between a first mode and a second mode in which the unfused toner image is fused to the recording medium. The flat surface is provided along a direction in which the recording medium enters the nip. The arc-shaped surface is provided downstream of the flat surface in the recording medium entry direction, is contiguous to the flat surface, and is curved toward the roller. In the first mode, the nip is regulated by the flat surface and the arc-shaped surface. In the second mode, the nip is regulated by the flat surface of the flat and arc-shaped surfaces.

DETAILED DESCRIPTION

Figure 1:
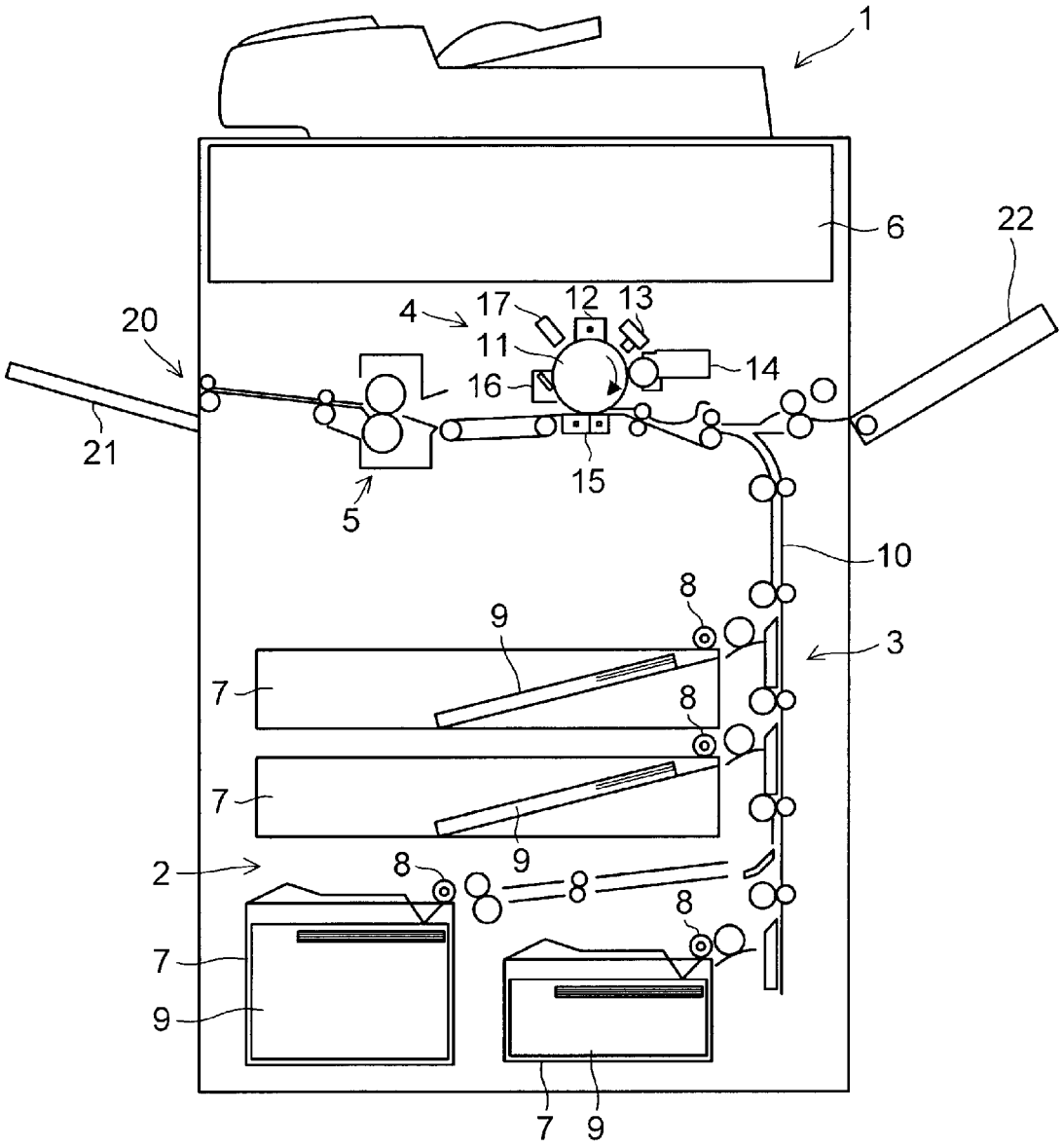
FIG. 1 is a diagram schematically showing a configuration of an image forming apparatus including a fusing device according to a first embodiment of the present disclosure.

Embodiments of the present disclosure will be described hereinafter with reference to the accompanying drawings.

The present disclosure is not intended to be limited to these embodiments. Applications described herein are exemplary in nature and are not intended to be an exhaustive list. Terms used herein are not intended to be limited to any particular narrow interpretation unless clearly stated otherwise, either expressly or impliedly, in this document. In the drawings, like parts are indicated by like reference characters and will not be redundantly described.

First Embodiment

FIG. 1 is a diagram schematically showing a configuration of an image forming apparatus including a fusing device according to an embodiment of the present disclosure. The image forming apparatus 1 includes a paper feed unit 2 provided at a lower portion of the image forming apparatus 1, a paper conveyance unit 3 provided on a lateral side of the paper feed unit 2, an image forming unit 4 provided above the paper conveyance unit 3, the fusing device 5 provided closer to an exit side than is the image forming unit 4, and an image reading unit 6 provided above the image forming unit 4 and the fusing device 5.

The paper feed unit 2 includes a plurality of paper feed cassettes 7 for holding paper 9 (recording medium), and a manual feed tray 22 for manually supplying paper. The paper 9 is fed out on a sheet by sheet basis by rotation of a feed roller 8 from a selected one of the paper feed cassettes 7 to the paper conveyance unit 3. A recording medium, such as paper having a size different from that of the paper 9 held in the paper feed cassettes 7, an envelope, and an OHP transparency, is placed on the manual feed tray 22. The manual feed tray 22 feeds out the recording medium placed thereon to the paper conveyance unit 3.

The paper 9 fed to the paper conveyance unit 3 is conveyed on a paper conveyance path 10 toward the image forming unit 4. The image forming unit 4 forms a toner image on the paper 9 by an electrophotographic process. To do so, the image forming unit 4 includes a photoconductive body 11 which is supported for rotation in a direction indicated by an arrow in FIG. 1, a charging unit 12, an exposing unit 13, a developing unit 14, a transfer unit 15, a cleaning unit 16, and a charge neutralizing unit 17. The charging unit 12, the exposing unit 13, the developing unit 14, the transfer unit 15, the cleaning unit 16, and the charge neutralizing unit 17 are provided around the photoconductive body 11 along the direction of the rotation.

The charging unit 12 includes a charging wire to which a high voltage is applied. When a surface of the photoconductive body 11 is caused to have a predetermined potential by corona discharge generated by the charging wire, the surface of the photoconductive body 11 is uniformly charged. Thereafter, when the surface of the photoconductive body 11 is irradiated by the exposing unit 13 with light which is generated based on image data of an original document which has been read by the image reading unit 6, the potential of the surface of the photoconductive body 11 is selectively lowered, so that an electrostatic latent image is formed on the surface of the photoconductive body 11.

Next, the developing unit 14 develops the electrostatic latent image on the surface of the photoconductive body 11 to form a toner image on the surface of the photoconductive body 11. The toner image is transferred by the transfer unit 15 to the paper 9 supplied between the photoconductive body 11 and the transfer unit 15.

The paper 9 having the transferred toner image is conveyed toward the fusing device 5, which is located downstream of the image forming unit 4 in the paper conveyance direction. The fusing device 5 applies heat and pressure to the paper 9 so that the toner image is melted and fused to the paper 9. Next, the paper 9 having the fused toner image is exited to an exit tray 21 by an exit roller pair 20.

After the toner image has been transferred to the paper 9 by the transfer unit 15, the toner remaining on the surface of the photoconductive body 11 is removed by the cleaning unit 16. Also, residual charge is removed from the surface of the photoconductive body 11 by the charge neutralizing unit 17. Thereafter, the photoconductive body 11 is charged again by the charging unit 12 so that image formation will subsequently be similarly performed.

Figure 2:
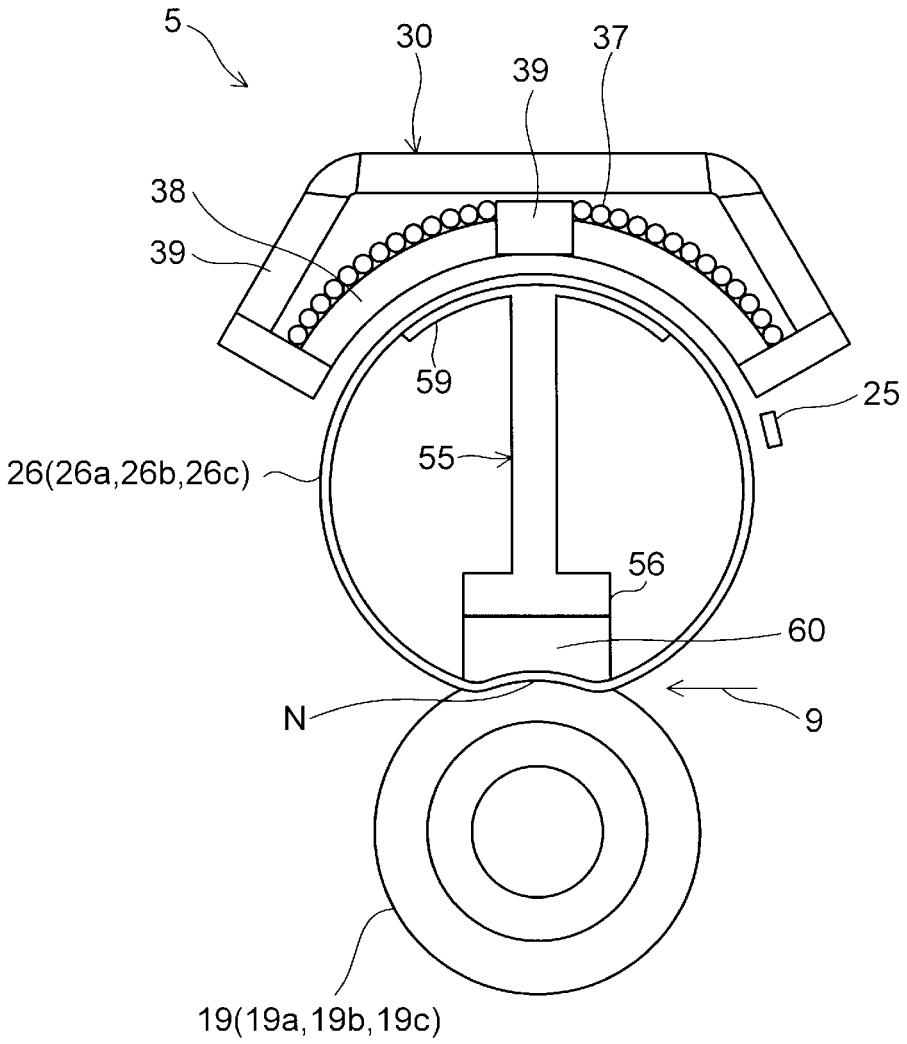
FIG. 2 is a cross-sectional side view schematically showing the fusing device of the first embodiment.

The fusing device 5 has a configuration shown in FIG. 2. FIG. 2 is a cross-sectional side view schematically showing the fusing device 5.

The fusing device 5 employs a fusing technique which utilizes induction heating. The fusing device 5 includes a fusing belt 26, a pressure roller 19, an induction heating unit 30 for heating the fusing belt 26, thermistors 25 as a temperature detecting unit, and a belt support member 55.

The fusing belt 26 is an endless heat-resistant belt. The fusing belt 26 is formed by successively stacking an induction heating layer 26*a*, an elastic layer 26*b*, and the release layer 26*c* from the inner circumferential side. The induction heating layer 26*a* is formed, for example, of electroformed nickel having a thickness of 30-50 μm. The elastic layer 26*b* is formed, for example, of silicone rubber having a thickness of 100-500 μm. The release layer 26*c* is formed, for example, of a fluorocarbon resin having a thickness of 30-50 μm, and is used to improve the releasability of the fusing belt 26 when an unfused toner image is melted and fused to a recording medium at a fusing nip N. Note that the induction heating layer 26*a* may be formed, for example, of a polyimide resin having a thickness of 50-100 μm which contains metal powder of copper, silver, aluminum, or the like.

The belt support member 55 has a guide portion 59 and a pad holding portion 56, and is formed of a metal (aluminum etc.), a heat-resistant resin, etc. The guide portion 59 is in the shape of an arc as viewed in cross section. The guide portion 59 holds the fusing belt 26 with the fusing belt 26 being separated from the induction heating unit 30 by a predetermined space. The pad holding portion 56 holds a pressing pad 60 which is a pressing member (regulating member). The pressing pad 60 is provided on an inner circumferential surface of the fusing belt 26, facing the pressure roller 19 with the fusing belt 26 being interposed between the pressing pad 60 and the pressure roller 19. The pressing pad 60 presses the fusing belt 26 against the pressure roller 19. Note that the pad holding portion 56 may be separated from the guide portion 59. In this case, for example, the pad holding portion 56 is supported by the apparatus body.

The pressure roller 19 includes a cylindrical cored bar 19*a* of stainless steel or the like, an elastic layer 19*b* of silicone rubber or the like formed on the cored bar 19*a*, and a release layer 19*c* of a fluorocarbon resin or the like covering a surface of the elastic layer 19*b*. The pressure roller 19 is driven to rotate by a drive source (not shown), such as a motor or the like. The fusing belt 26 is rotated by rotation of the pressure roller 19. The fusing belt 26 is pressed against the pressure roller 19 so that the fusing nip N is formed at a portion where the pressure roller 19 and the fusing belt 26 are in contact with each other. At the fusing nip N, heat and pressure are applied to the unfused toner image on the paper 9 conveyed so that the toner image is fused to the paper 9.

The induction heating unit 30 includes a coil 37, a bobbin 38, and a magnetic core 39. As a result, the induction heating unit 30 heats the fusing belt 26 by electromagnetic induction.

The induction heating unit 30 is arranged to face the fusing belt 26, extending in a width direction (a direction perpendicular to the drawing sheet of FIG. 2) of the fusing belt 26 to cover substantially half of the outer circumference of the fusing belt 26.

The excitation coil 37 is a loop of Litz wire wound several times along the width direction (the direction perpendicular to the drawing sheet of FIG. 2) of the fusing belt 26, and is mounted to the bobbin 38. The excitation coil 37 is connected to a power supply (not shown), and generates alternating magnetic flux from a high-frequency current supplied from the power supply. The magnetic flux from the excitation coil 37 passes through the magnetic core 39, and is guided in a direction parallel to the drawing sheet of FIG. 2 to pass along the induction heating layer 26*a* of the fusing belt 26. An eddy current is generated in the induction heating layer 26*a* by alternating changes in the intensity of the magnetic flux passing along the induction heating layer 26*a*. When the eddy current flows in the induction heating layer 26*a*, Joule's heat is generated due to the electric resistance of the induction heating layer 26*a*, so that the fusing belt 26 generates heat.

The thermistors 25 are provided at a predetermined height from the outer surface of the fusing belt 26, facing a middle portion and opposite end portions in the width direction of the fusing belt 26. The thermistors 25 detect temperatures of the middle portion and the opposite end portions. A current supplied to the excitation coil 37 of the induction heating unit 30 is controlled based on the temperatures detected by the thermistors 25.

The fusing belt 26 is heated by the induction heating unit 30 which is heating means (heating unit). The paper 9 held in the fusing nip N is heated by the fusing belt 26 and pressed by the pressure roller 19. As a result, the toner powder is melted and fused to the paper 9 at a temperature which allows fusing. After the fusing process, the paper 9 is conveyed while being tightly attached to the surface of the fusing belt 26, and thereafter, is released from the surface of the fusing belt 26 by a separation member (not shown), and is conveyed downstream of the fusing device 5.

Figure 3:
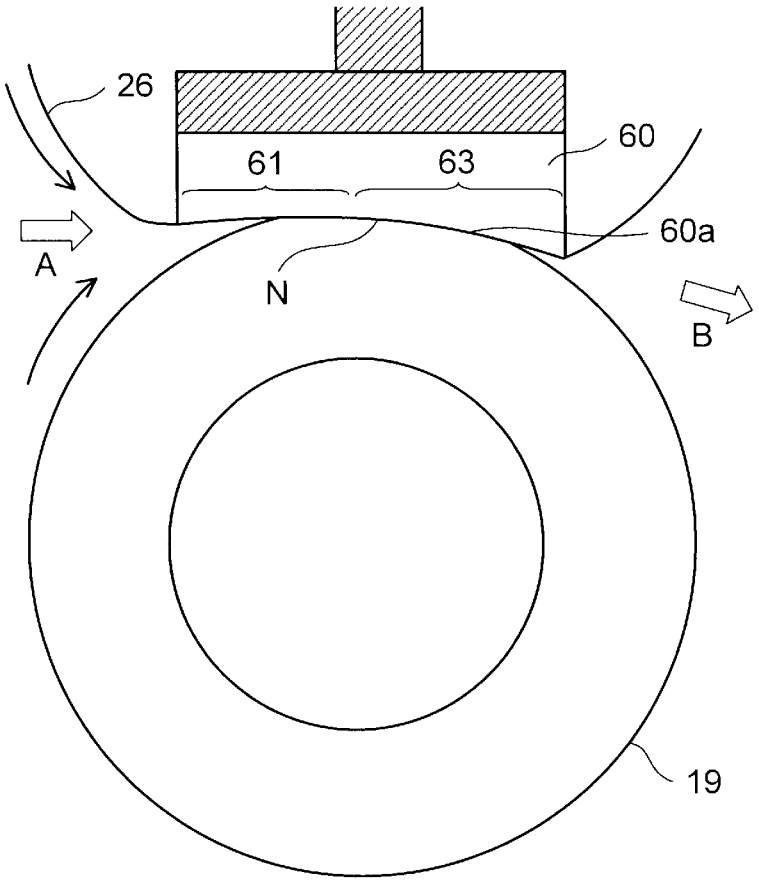
FIG. 3 is a cross-sectional side view showing a pressing member of the fusing device of the first embodiment.

FIG. 3 shows a detailed configuration in the vicinity of the pressing pad 60 and the fusing nip N. FIG. 3 is a cross-sectional side view of the configuration in the vicinity of the pressing pad 60 and the fusing nip N. Note that FIG. 3 is a view of the fusing nip N from behind the drawing sheet of FIG. 2, and therefore, the paper 9 is conveyed relative to the fusing nip N in directions indicated by arrows A and B.

The pressing pad 60 is formed of a heat-resistant resin, such as a liquid crystal polymer resin or the like, or an elastic material, such as silicone rubber or the like. The pressing pad 60 may include an elastomer at a sliding surface 60*a* which faces the fusing belt 26. In order to reduce the sliding load of a contact surface between the sliding surface 60*a* and the fusing belt 26, a sliding member (not shown) of a fluorocarbon resin, such as a polytetrafluoroethylene (PTFE) sheet or the like, may be interposed between the sliding surface 60*a* and the fusing belt 26. When the pressing pad 60 is formed of a liquid crystal polymer resin, deformation of the pressing pad 60 due to heat and pressure applied thereto is prevented or reduced, whereby the shape of the fusing nip N can be maintained unchanged over a long period of time.

The sliding surface 60*a* of the pressing pad 60 has a flat portion 61 (flat surface) which is generally parallel to the paper conveyance direction on an upstream side of the fusing nip N (a direction indicated by arrow A in FIG. 3), and an arc-shaped portion 63 (arc-shaped surface) which is located downstream of the flat portion 61 in the paper conveyance direction and is curved toward the pressure roller 19. Specifically, the flat portion 61 is formed along a direction in which the paper 9 enters the fusing nip N (the direction indicated by arrow A in FIG. 3). The arc-shaped portion 63 is formed downstream of the flat portion 61 in the direction in which the paper 9 enters, and is contiguous to the flat portion 61 and curved toward the pressure roller 19. Note that the direction indicated by arrow A in FIG. 3 is one in which the paper 9 enters the fusing nip N. In other words, the direction indicated by arrow A in FIG. 3 is the paper conveyance direction on the upstream side of the fusing nip N.

The arc-shaped portion 63 has a larger radius of curvature than that of an outer circumferential surface of the pressure roller 19. This configuration allows the pressing force (nip pressure) of the fusing nip N to become lower toward from upstream to downstream in the paper conveyance direction. Therefore, the pressing pad 60 is less likely to deform due to heat of the fusing belt 26 and pressure of the pressure roller 19. As a result, the releasability of the downstream end portion of the fusing nip N with respect to the paper 9 can be maintained over a long period of time.

In this embodiment, a first mode and a second mode are provided, and the fusing device 5 can be switched between the two modes. In the first mode, the pressure roller 19 is pressed against the flat portion 61 and the arc-shaped portion 63 with the fusing belt 26 being interposed between the pressure roller 19, and the flat portion 61 and the arc-shaped portion 63, to form the fusing nip N. In other words, in the first mode, the flat portion 61 and the arc-shaped portion 63 regulate the fusing nip N. In the second mode, the pressure roller 19 is pressed against only the flat portion 61 (i.e., of the flat portion 61 and the arc-shaped portion 63, the flat portion 61) with the fusing belt 26 being interposed between the pressure roller 19 and the flat portion 61, to form the fusing nip N. In other words, in the second mode, of the flat portion 61 and the arc-shaped portion 63, the flat portion 61 regulates the fusing nip N.

When the fusing process is performed on plain paper, such as A4 paper or the like, the pressure roller 19 is pressed against the flat portion 61 and the arc-shaped portion 63 by a predetermined pressure with the fusing belt 26 being interposed between the pressure roller 19, and the flat portion 61 and the arc-shaped portion 63 (first mode). In this configuration, the flat portion 61 and the arc-shaped portion 63 are successively and contiguously arranged from upstream in the paper conveyance direction to form the fusing nip N. Therefore, the paper 9 entering the fusing nip N firstly passes the flat portion 61 and then the arc-shaped portion 63. Therefore, the paper 9 can be stably inserted into the fusing nip N. When the paper 9 passes the arc-shaped portion 63, the toner has already been melted and fused to the paper 9 to some extent. As a result, the fused image is less likely to be disturbed when the paper 9 passes the arc-shaped portion 63 where nip pressure is likely to vary, and therefore, stable fusing performance can be provided.

On the other hand, when the fusing process is performed on a recording medium, such as an envelope or the like, the pressure roller 19 is pressed against only the flat portion 61 (i.e., of the flat portion 61 and the arc-shaped portion 63, the flat portion 61) by a predetermined pressure with the fusing belt 26 being interposed between the pressure roller 19 and the flat portion 61 (second mode). In this configuration, the fusing nip N becomes flat to provide a predetermined nip pressure, and a width (fusing nip width) across which the pressing pad 60 and the pressure roller 19 are in contact with each other is relatively short. Therefore, when a recording medium, such as an envelope or the like, passes through the fusing nip N, the front and back sides of the envelope have the same conveyance speed, and the nip pressure applied to the envelope is generally reduced. As a result, wrinkles and/or flap misalignment of the envelope can be reduced.

Figure 4:
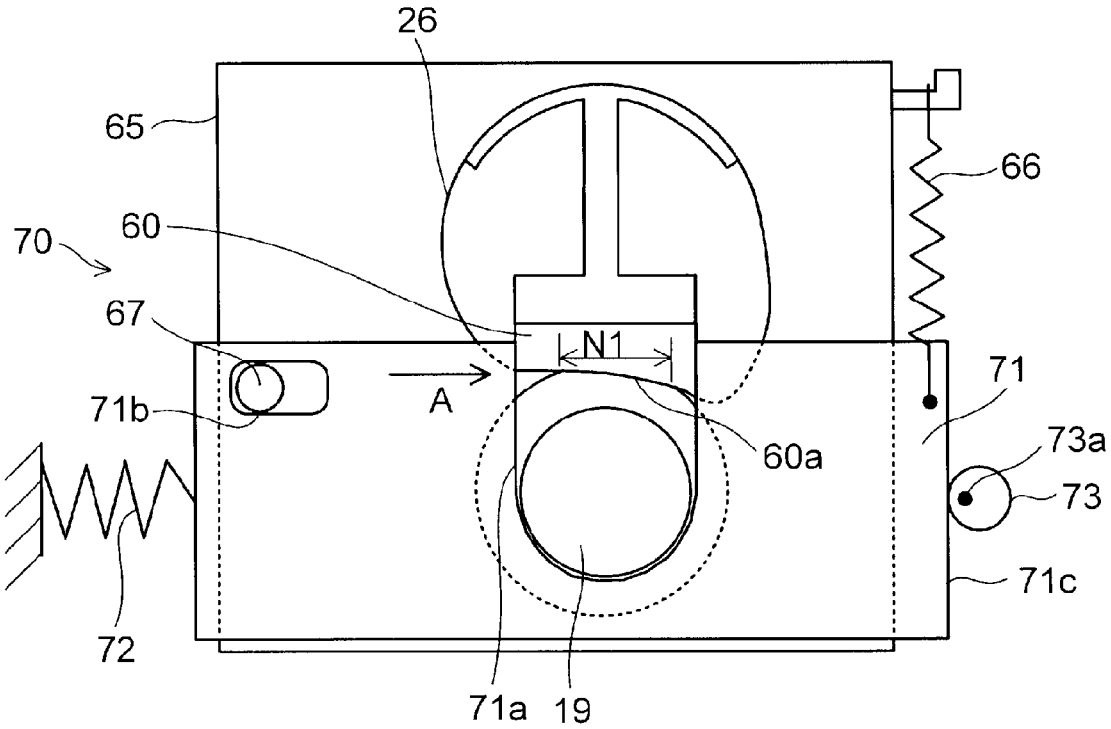
FIG. 4 is a side view schematically showing a switching mechanism in a first mode of the fusing device of the first embodiment.
Figure 5:
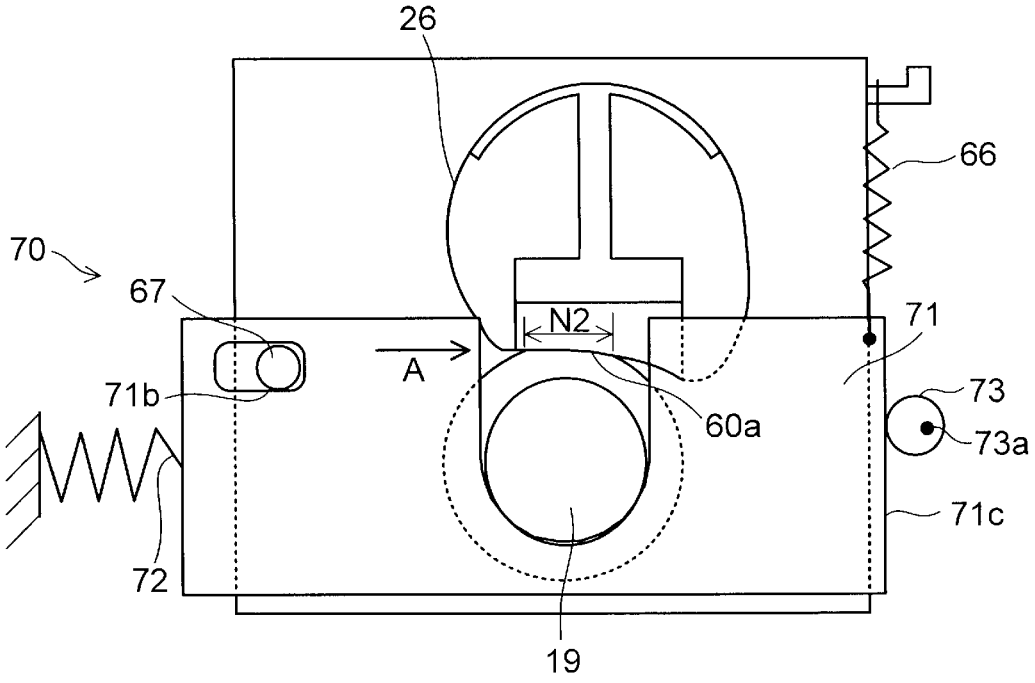
FIG. 5 is a side view schematically showing the switching mechanism in a second mode of the fusing device of the first embodiment.

FIGS. 4 and 5 show a configuration of the switching mechanism. FIG. 4 is a side view schematically showing a configuration of the switching mechanism in the first mode. FIG. 5 is a side view schematically showing a configuration of the switching mechanism in the second mode. Note that a pair of holding plates 71 and a pair of side plates 65 are provided on opposite sides (corresponding to the front and back sides of the drawing sheets of FIGS. 4 and 5) of the fusing belt 26. In FIGS. 4 and 5, the side plate 65 provided on the front side of the drawing sheet is not shown for ease of understanding the configuration of the members. Here, in order to clearly describe a connection between each member, the holding plate 71 and the side plate 65 on the front side of the drawing sheet of FIG. 5 may also be referred to as the front holding plate 71 and the front side plate 65, respectively. Members corresponding to the front holding plate 71 and the front side plate 65 may also be referred to as front members. The holding plate 71 and the side plate 65 on the back side of the drawing sheet of FIG. 5 may also be referred to as the back holding plate 71 and the back side plate 65, respectively. Members corresponding to the back holding plate 71 and the back side plate 65 may also be referred to as back members. Note that the terms "front" and "back" may also be similarly used in the description of FIGS. 6 and 7 below.

As shown in FIG. 4, the switching mechanism 70 has the pair of holding plates 71 as a holding member, a pair of cam plates 73 as an actuation member, and a pair of spring members 72 as a first biasing member.

The pair of holding plates 71 are provided at both ends of the support shaft of the pressure roller 19, and are each a generally rectangular, flat plate. A pressure roller holding portion 71*a* which is a U-shaped oblong hole is provided at an upper edge portion of each holding plate 71. The pressure roller holding portions 71*a* rotatably hold the support shaft of the pressure roller 19. A guide hole 71*b* which is an oblong hole extending in the paper conveyance direction A is formed at a left edge portion (an upstream side in the paper conveyance direction (paper entry direction) A) of each holding plate 71. A guide pin 67 is fixed to each side plate 65, which is a member of the body of the fusing device 5. The guide pin 67 is fitted in the guide hole 71*b*. Therefore, the holding plate 71 is held for movement along the guide hole 71*b* in the paper conveyance direction A, i.e., in a direction generally parallel to the flat portion 61 (see FIG. 3). Here, the guide pin 67 shown is provided on the front side plate 65. Note that, in addition, another guide hole 71*b* in which another guide pin 67 is fitted may be formed at a right edge portion (a downstream side in the paper conveyance direction A) of the holding plate 71. In this case, the holding plate 71 can more smoothly move in the paper conveyance direction A. The pressure roller holding portion 71*a* may be a circular hole which rotatably holds the support shaft of the pressure roller 19.

A front pressure spring 66, such as a tension coil spring or the like, is provided between a right edge portion (a downstream side in the paper conveyance direction A) of the front holding plate 71 and the front side plate 65. Similarly, a back pressure spring 66 is provided between a right edge portion (a downstream side in the paper conveyance direction A) of the back holding plate 71 and the back side plate 65. The holding plate 71 is biased upward in FIG. 4 by the biasing force of the pressure spring 66. By the holding plate 71 being biased upward in FIG. 4 by the pressure spring 66, the pressure roller 19 is pressed against the pressing pad 60 with the fusing belt 26 being interposed between the pressure roller 19 and the pressing pad 60, so that the pressure roller 19 and the fusing belt 26 form a fusing nip N1. The fusing nip N1 is formed by the pressure roller 19 being pressed against the flat portion 61 and the arc-shaped portion 63 of the sliding surface 60*a* with the fusing belt 26 being interposed between the pressure roller 19, and the flat portion 61 and the arc-shaped portion 63 (see FIG. 3). Thus, the pressing pad 60 having the sliding surface 60*a* is a regulating member for regulating the fusing nip N1 which is formed by the pressure roller 19 and the fusing belt 26. The fusing device 5 in the first mode in which the fusing nip N1 is formed is suitable for the fusing process for plain paper, such as A4 paper and the like.

The front spring member 72 for biasing the front holding plate 71 to the downstream side in the paper conveyance direction A is provided at a left edge portion of the front holding plate 71. Similarly, the back spring member 72 for biasing the back holding plate 71 to the downstream side in the paper conveyance direction A is provided at a left edge portion of the back holding plate 71. The front cam plate 73 is provided in the vicinity of a right edge portion of the front holding plate 71. Similarly, the back cam plate 73 is provided in the vicinity of a right edge portion of the back holding plate 71. The cam plate 73 is mounted to the apparatus body (not shown) for rotation about a rotating shaft 73*a*. The cam plate 73 has a circular outer edge portion which is pressed against and made contact with a cam contact surface 71*c* which is formed at a right edge portion of the holding plate 71. The rotating shaft 73*a* is located away from the center of the circle of the cam plate 73. When the rotating shaft 73*a* is rotated by a drive source (not shown), such as a motor or the like, the eccentric cam plate 73 is also rotated. When the cam plate 73 is rotated by 180 degrees about the rotating shaft 73*a*, the holding plate 71 performs a leftward translational movement in FIG. 4 (to the upstream side in the paper conveyance direction A) against the biasing force of the spring member 72, along with the pressure roller 19, due to the engagement of the guide hole 71*b* and the guide pin 67, resulting in the second mode (the state shown in FIG. 5). In other words, the spring member 72 (first biasing member) biases the holding plate 71 (holding member) in the paper entry direction A, and the cam plate 73 (actuation member) moves the holding plate 71 against the biasing force of the spring member 72 in a direction opposite to the paper entry direction A. As a result, the fusing device 5 is switched from the first mode to the second mode.

In the second mode of FIG. 5, the pressure roller 19 is located on the upstream side in the paper conveyance direction A (in the direction generally parallel to the flat portion 61 of the sliding surface 60*a*), and therefore, a fusing nip N2 is formed by the pressure roller 19 being pressed against only the flat portion 61 of the sliding surface 60*a* with the fusing belt 26 being interposed between the pressure roller 19 and the flat portion 61 of the sliding surface 60*a* (see FIG. 3). Thus, the pressing pad 60 having the sliding surface 60*a* is a regulating member for regulating the fusing nip N2 formed by the pressure roller 19 and the fusing belt 26. The fusing nip N2 has a shorter width than that of the fusing nip N1 in the first mode, and has a flat shape. As a result, the fusing device 5 in the second mode in which the fusing nip N2 is formed is suitable for the fusing process for recording media, such as an envelope and the like.

When the fusing device 5 is switched from the second mode to the first mode, the cam plate 73 is rotated by 180 degrees about the rotating shaft 73*a*. Thus, when the eccentric cam plate 73 is rotated, the holding plate 71 is moved by the biasing force of the spring member 72 along the guide hole 71*b* to the downstream side in the paper conveyance direction A, resulting in the state of the fusing device 5 shown in FIG. 4.

As described above, the switching mechanism 70 reciprocally moves the pressure roller 19 in the paper entry direction A and in the direction opposite to the paper entry direction A, to switch the fusing device 5 between the first mode and the second mode. Specifically, the switching mechanism 70 moves the pressure roller 19 in the direction opposite to the paper entry direction A to switch the fusing device 5 from the first mode to the second mode. On the other hand, the switching mechanism 70 moves the pressure roller 19 in the paper entry direction A to switch the fusing device 5 from the second mode to the first mode. Note that the holding plates 71 hold the pressure roller 19 so that the pressure roller 19 can move in the paper entry direction A and in the direction opposite to the paper entry direction A.

Although, in the above embodiment, the spring member 72 biases the holding plate 71 to the downstream side in the paper conveyance direction A so that the cam plate 73 is invariably pressed against and made contact with the cam contact surface 71*c* at the right edge portion of the holding plate 71, the present disclosure is not limited to this. For example, the spring member 72 may bias the holding plate 71 to the upstream side in the paper conveyance direction A and the cam contact surface 71*c* may be provided at a left edge portion of the holding plate 71 so that the cam plate 73 is invariably pressed against and made contact with the cam contact surface 71*c* (first variation). Thus, in the first embodiment and the first variation described with respect to FIGS. 4 and 5, the spring member 72 (first biasing member) biases the holding plate 71 (holding member) in a direction along the paper entry direction A. The cam plate 73 (actuation member) moves the holding plate 71 in a direction RA opposite to the direction along the paper entry direction A. The holding plate 71 holds the pressure roller 19 so that the pressure roller 19 can move in the direction along the paper entry direction A and the opposite direction RA. In the first embodiment described with respect to FIGS. 4 and 5, the direction along the paper entry direction A means the paper entry direction A. In the first variation, the direction along the paper entry direction A means the direction opposite to the paper entry direction A.

Alternatively, for example, the spring member 72 may bias the holding plate 71 in the paper conveyance direction A so that, in one of the first and second modes, the holding plate 71 is pressed against and made contact with the apparatus body, and is thereby held at a predetermined first position, and in the other mode, the holding plate 71 is pressed against and made contact with the cam plate 73, and is thereby held at a predetermined second position (second variation). The first and second variations have advantages similar to those of the embodiment described with reference to FIGS. 4 and 5.

Second Embodiment

Figure 6:
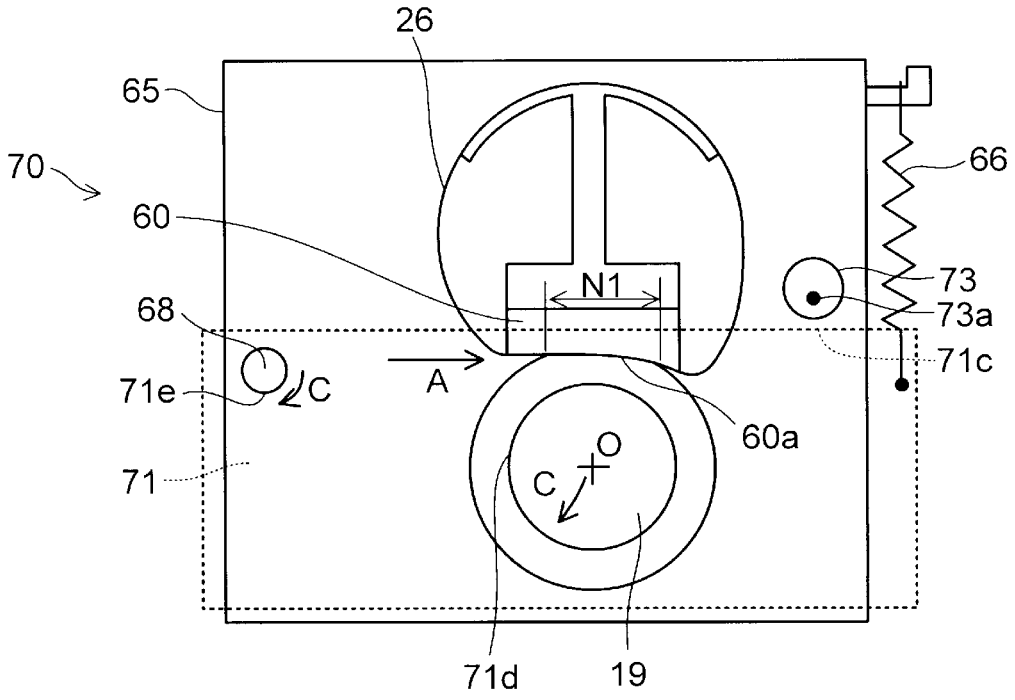
FIG. 6 is a side view schematically showing a switching mechanism in a first mode of a fusing device according to a second embodiment.
Figure 7:
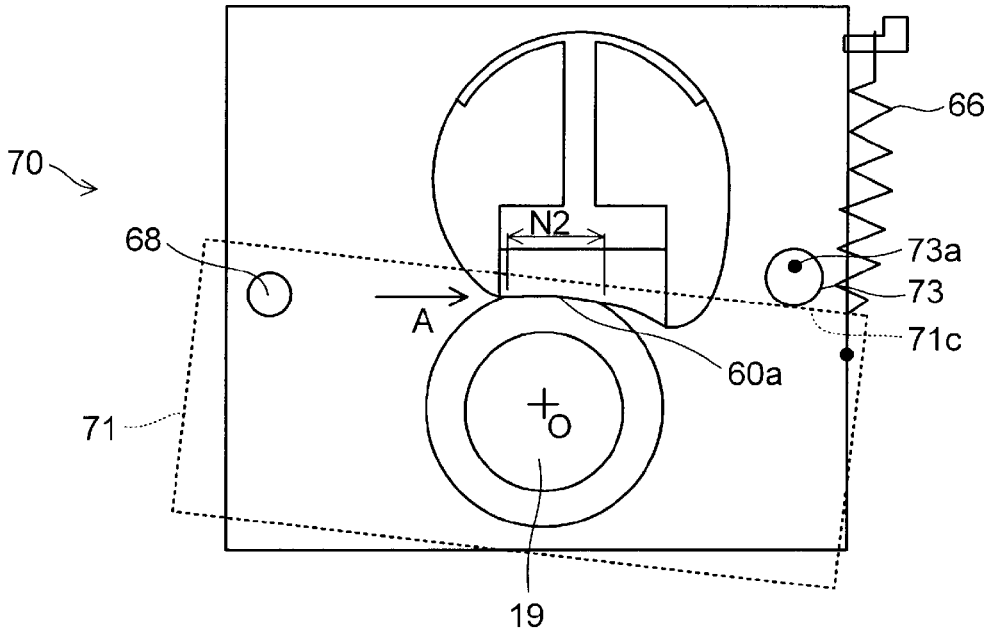
FIG. 7 is a side view schematically showing the switching mechanism in a second mode of the fusing device of the second embodiment.

FIGS. 6 and 7 show a configuration of a switching mechanism 70 according to a second embodiment. FIG. 6 is a side view schematically showing the switching mechanism 70 in the first mode. FIG. 7 is a side view schematically showing the switching mechanism 70 in the second mode. In the second embodiment, the switching mechanism 70 rotates holding plates 71 to switch the fusing device from the first mode to the second mode or from the second mode to the first mode. Differences in the switching mechanism 70 between the first and second embodiments will be mainly described hereinafter, and the same parts as those of the first embodiment will not be described. Note that a pair of holding plates 71 and a pair of side plates 65 are provided on opposite sides (corresponding to the front and back sides of the drawing sheets of FIGS. 6 and 7) of a fusing belt 26. Note that, in FIGS. 6 and 7, the front side plate 65 provided on the front side of the drawing sheet is not shown for ease of understanding the configuration of the members. Because the holding plate 71, a pressing pad 60, a pressure roller 19, and the like overlap on the drawing sheet, an outer shape of the holding plate 71 is indicated by a dashed line for ease of understanding the configuration of the members.

As shown in FIG. 6, the switching mechanism 70 includes the pair of holding plates 71 as a holding member, a pair of the cam plates 73 as an actuation member, and a pair of pressure springs 66 as a second biasing member.

The pair of holding plates 71 are provided at both ends of the support shaft of the pressure roller 19, and has a generally rectangular, flat shape. Each holding plate 71 has a fitting hole 71*d* for rotatably holding the support shaft of the pressure roller 19. A rotation support hole 71*e* is provided at an upper portion of a left edge of each holding plate 71. A support shaft 68 which is fixed to the side plate 65 is fitted in the rotation support hole 71*e* so that the holding plate 71 can rotate. Here, the support shaft 68 shown is provided in the front side plate 65. The rotation support hole 71*e* is provided at a position which is located upstream of a fusing nip N in a paper conveyance direction (paper entry direction) A, and is closer to the pressing pad 60 than to the center O of rotation of the pressure roller 19. Because of the position of the rotation support hole 71*e* (pivot), when the holding plate 71 is rotated clockwise (in a direction indicated by arrow C) about the support shaft 68, the pressure roller 19 is rotated clockwise (in the direction indicated by arrow C) about the support shaft 68. In other words, the pressure roller 19 moves downward in FIG. 6 (in a direction away from the pressing pad 60) to a position which is on a further upstream side in the paper conveyance direction A than before the rotation.

A front pressure spring 66, such as a tension coil spring or the like, is provided between a right edge portion (on a downstream side in the paper conveyance direction A) of the front holding plate 71 and the front side plate 65. Similarly, a back pressure spring 66 is provided between a right edge portion (on a downstream side in the paper conveyance direction A) of the back holding plate 71 and the back side plate 65. The holding plate 71 is biased upward in FIG. 6 by the biasing force of the pressure spring 66. In other words, the holding plate 71 is biased by the biasing force of the pressure spring 66 in a direction in which the pressure roller 19 is moved toward the pressing pad 60. By the holding plate 71 being biased upward in FIG. 6 by the pressure spring 66, the pressure roller 19 is pressed against the pressing pad 60 with the fusing belt 26 being interposed between the pressure roller 19 and the pressing pad 60. As a result, the pressure roller 19 and the fusing belt 26 form a fusing nip N1 which has a predetermined nip pressure. The fusing nip N1 is formed by the pressure roller 19 being pressed against the flat portion 61 and the arc-shaped portion 63 of the sliding surface 60*a* (see FIG. 3) with the fusing belt 26 being interposed between the pressure roller 19, and the flat portion 61 and the arc-shaped portion 63 of the sliding surface 60*a*. Thus, the pressing pad 60 having the sliding surface 60*a* is a regulating member for regulating the fusing nip N1 formed by the pressure roller 19 and the fusing belt 26. The fusing device 5 in the first mode in which the fusing nip N1 is formed is suitable for the fusing process for plain paper, such as A4 paper and the like.

The front cam plate 73 is provided at an upper edge portion of the front holding plate 71 in the vicinity of the front pressure spring 66. Similarly, the back cam plate 73 is provided at an upper edge portion of the back holding plate 71 in the vicinity of the back pressure spring 66. The front cam plate 73 is attached to the front side plate 65 for rotation about the front rotating shaft 73*a*. Similarly, the back cam plate 73 is attached to the back side plate 65 for rotation about the back rotating shaft 73*a*. The cam plate 73 has a circular outer edge portion. The cam plate 73 is configured to allow the outer edge portion of the cam plate 73 to be made contact with and separated from a cam contact surface 71*c* which is formed at an upper edge portion of the holding plate 71. In the state (first mode) of FIG. 6, the cam plate 73 is located away from the cam contact surface 71*c*. A rotating shaft 73*a* is provided at a position which is located away from the center of the circle of the cam plate 73. When the cam plate 73 is rotated about the rotating shaft 73*a* by a drive source (not shown), such as a motor or the like, the eccentric cam plate 73 is rotated. When the cam plate 73 is rotated by 180 degrees about the rotating shaft 73*a*, the outer edge portion of the cam plate 73 is pressed against the cam contact surface 71*c* of the holding plate 71, and the holding plate 71 is moved downward against the biasing force of the pressure spring 66. In other words, the holding plate 71 is rotated in a direction indicated by arrow C about the support shaft 68 along with the pressure roller 19, resulting in the second mode (the state shown in FIG. 7). Thus, the pressure roller 19 is rotated and moved in a direction away from the pressing pad 60, so that the pressure roller 19 is moved to the upstream side in the paper entry direction A, and therefore, the fusing device 5 is switched from the first mode to the second mode.

In the second mode of FIG. 7, the pressure roller 19 has been rotated about the support shaft 68 in the direction indicated by arrow C in FIG. 6. As a result, a fusing nip N2 is formed by the pressure roller 19 being pressed against only the flat portion 61 of the sliding surface 60*a* (see FIG. 3) (i.e., of the flat portion 61 and the arc-shaped portion 63, the flat portion 61) with the fusing belt 26 being interposed between the pressure roller 19 and the flat portion 61 of the sliding surface 60*a*. The fusing nip N2 has a lower nip pressure than that of the fusing nip N1 in the first mode. The fusing nip N2 has a shorter width than that of the fusing nip N1 in the first mode, also has a flat shape, and therefore, has a lower fusing nip pressure. As a result, the fusing device 5 in the second mode in which the fusing nip N2 is formed is suitable for the fusing process for recording media, such as an envelope and the like.

When the fusing device 5 is switched from the second mode to the first mode, the cam plate 73 is rotated by 180 degrees about the rotating shaft 73*a*. As a result, the cam plate 73 is separated from the cam contact surface 71*c* of the holding plate 71, and the holding plate 71 is rotated anticlockwise about the support shaft 68 by the biasing force of the pressure spring 66, resulting in the state of FIG. 6.

Note that, as described with reference to FIGS. 6 and 7, the switching mechanism 70 includes the support shaft 68 (shaft) along the support shaft (rotating shaft) of the pressure roller 19. The support shaft 68 is provided outside the pressure roller 19. The switching mechanism 70 rotates and moves the pressure roller 19 about the support shaft 68 to switch the fusing device 5 between the first mode and the second mode. Specifically, the switching mechanism 70 rotates and moves the pressure roller 19 in a direction away from the arc-shaped portion 63 to switch the fusing device 5 from the first mode to the second mode, and in a direction toward the arc-shaped portion 63 to switch the fusing device 5 from the second mode to the first mode. As described above, in the second embodiment, when the fusing process is performed on a recording medium, such as plain paper (e.g., A4 paper) or the like, the switching mechanism 70 switches the fusing device 5 to the first mode so that the fusing nip N1 is formed in a flat shape and in an arc-like shape. As a result, an unfused toner image on the recording medium is consistently satisfactory fused. On the other hand, when the fusing process is performed on a recording medium, such as an envelope or the like, the switching mechanism 70 switches the fusing device 5 to the second mode so that the fusing nip N2 is formed in a flat shape. As a result, wrinkles (e.g., wrinkles of an envelope) and/or flap misalignment (e.g., flap misalignment of an envelope) of the recording medium are reduced, and an unfused toner image on the recording medium is satisfactorily fused.

Note that the present disclosure is not intended to be limited to the first and second embodiments. Various changes and modifications can be made without departing the scope and spirit of the present disclosure. For example, the present disclosure is intended to cover the following variations.

(1) Although, in the first and second embodiments, the induction heating unit 30 is employed as heating means, the present disclosure is not limited to this. For example, the heating means may be a halogen lamp or the like.

(2) Although the fusing belt 26 is heated in the fusing device 5 described with reference to FIG. 2, the pressure roller 19 may be heated instead of the fusing belt 26. In the fusing device 5 described with reference to FIGS. 4-7, the pressing pad 60 and the fusing belt 26 are fixed, and force is applied to the pressure roller 19 so that the pressure roller 19 is pressed against the pressing pad 60 and the fusing belt 26 to form the nip N. Alternatively, the pressure roller 19 may be fixed, and force is applied to the pressing pad 60 and the fusing belt 26 so that the pressing pad 60 and the fusing belt 26 are pressed against the pressure roller 19 to form the nip N.

As described above, according to the embodiments of the present disclosure, when the fusing process is performed on a recording medium, such as plain paper (e.g., A4 paper) or the like, the switching mechanism switches the fusing device to the first mode so that the fusing nip is formed in a flat shape and in an arc-shaped shape. As a result, an unfused toner image on the recording medium is consistently satisfactorily fused. On the other hand, when the fusing process is performed on a recording medium, such as an envelope or the like, the switching mechanism switches the fusing device to the second mode so that the fusing nip is formed in a flat shape. As a result, wrinkles (e.g., wrinkles of an envelope) and/or flap misalignment (e.g., flap misalignment of an envelope) of the recording medium are reduced, and therefore, an unfused toner image on the recording medium is satisfactorily fused.

What is claimed is:

1. A fusing device for fusing an unfused toner image formed on a recording medium, to the recording medium, comprising:

a regulating member having a flat surface and an arc-shaped surface and configured to regulate a nip formed by an endless belt and a roller; and a switching mechanism configured to switch the fusing device between a first mode and a second mode in which the unfused toner image is fused to the recording medium, wherein the flat surface is provided along a direction in which the recording medium enters the nip, the arc-shaped surface is provided downstream of the flat surface in the recording medium entry direction, is contiguous to the flat surface, and is curved toward the roller, in the first mode, the nip is regulated by the flat surface and the arc-shaped surface, in the second mode, the nip is regulated by the flat surface, the switching mechanism includes a holding member configured to rotatably hold the roller, a first biasing member configured to bias the holding member in a direction along the recording medium entry direction, and an actuation member configured to move the holding member in a direction opposite to the direction along the recording medium entry direction, and the holding member holds the roller so that the roller is allowed to move in the direction along the recording medium entry direction and in the direction opposite to the direction along the recording medium entry direction.

2. The fusing device of claim 1, wherein the switching mechanism reciprocally moves the roller in the recording medium entry direction and in a direction opposite to the recording medium entry direction, to switch the fusing device between the first mode and the second mode.

3. The fusing device of claim 2, wherein the switching mechanism moves the roller in the opposite direction to the recording medium entry direction to switch the fusing device from the first mode to the second mode, and moves the roller in the recording medium entry direction to switch the fusing device from the second mode to the first mode.

4. The fusing device of claim 1, wherein the endless belt is heated to heat the recording medium, and the roller applies pressure to the recording medium.

5. The fusing device of claim 1, wherein the arc-shaped surface has a radius of curvature larger than that of an outer circumferential surface of the roller.

6. An image forming apparatus comprising:

an image forming unit configured to form a toner image on a recording medium; and the fusing device of claim 1.

7. A fusing device for fusing an unfused toner image formed on a recording medium, to the recording medium, comprising:

a regulating member having a flat surface and an arc-shaped surface and configured to regulate a nip formed by an endless belt and a roller; and a switching mechanism configured to switch the fusing device between a first mode and a second mode in which the unfused toner image is fused to the recording medium, wherein the flat surface is provided along a direction in which the recording medium enters the nip, the arc-shaped surface is provided downstream of the flat surface in the recording medium entry direction, is contiguous to the flat surface, and is curved toward the roller, in the first mode, the nip is regulated by the flat surface and the arc-shaped surface, in the second mode, the nip is regulated by the flat surface, the switching mechanism includes a shaft along a rotating shaft of the roller, the shaft is provided outside the roller, and the switching mechanism switches the fusing device between the first mode and the second mode by rotating and moving the roller about the shaft.

8. The fusing device of claim 7, wherein the switching mechanism switches the fusing device from the first mode to the second mode by rotating and moving the roller in a direction away from the arc-shaped surface, and switches the fusing device from the second mode to the first mode by rotating and moving the roller in a direction toward the arc-shaped surface.

9. The fusing device of claim 7, wherein the endless belt is heated to heat the recording medium, and the roller applies pressure to the recording medium.

10. The fusing device of claim 7, wherein the arc-shaped surface has a radius of curvature larger than that of an outer circumferential surface of the roller.

11. An image forming apparatus comprising:

an image forming unit configured to form a toner image on a recording medium; and the fusing device of claim 7.

12. A fusing device for fusing an unfused toner image formed on a recording medium, to the recording medium, comprising:

a regulating member having a flat surface and an arc-shaped surface and configured to regulate a nip formed by an endless belt and a roller; and a switching mechanism configured to switch the fusing device between a first mode and a second mode in which the unfused toner image is fused to the recording medium, wherein the flat surface is provided along a direction in which the recording medium enters the nip, the arc-shaped surface is provided downstream of the flat surface in the recording medium entry direction, is contiguous to the flat surface, and is curved toward the roller, in the first mode, the nip is regulated by the flat surface and the arc-shaped surface, in the second mode, the nip is regulated by the flat surface, when the switching mechanism switches the fusing device from the first mode to the second mode, the switching mechanism changes nip pressure of the nip so that the nip pressure of the nip is lower in the second mode than in the first mode.

13. The fusing device of claim 12, wherein the switching mechanism includes a holding member configured to rotatably hold the roller at a position, as a pivot, located upstream of the nip in the recording medium entry direction, the position being closer to the regulating member than to a center of rotation of the roller, a second biasing member configured to bias the holding member in a direction which allows the roller to move toward the regulating member, and an actuation member configured to rotate and move the holding member in a direction which allows the roller to move away from the regulating member, thereby moving the roller to an upstream side in the recording medium entry direction.

14. The fusing device of claim 12, wherein the endless belt is heated to heat the recording medium, and the roller applies pressure to the recording medium.

15. The fusing device of claim 12, wherein the arc-shaped surface has a radius of curvature larger than that of an outer circumferential surface of the roller.

16. An image forming apparatus comprising:

an image forming unit configured to form a toner image on a recording medium; and the fusing device of claim 12.

* * * * *